United States Patent [19]

Hirosawa et al.

[11] 3,948,240

[45] Apr. 6, 1976

[54] AUTOMATIC CHOKE VALVE APPARATUS FOR AN INTERNAL COMBUSTION ENGINE

[75] Inventors: Yoshiaki Hirosawa, Tokyo; Toshio Nomura, Niiza; Masahiko Iiyama, Tokyo, all of Japan

[73] Assignee: Honda Giken Kogyo Kabushiki Kaisha, Tokyo, Japan

[22] Filed: Mar. 14, 1975

[21] Appl. No.: 558,714

[30] Foreign Application Priority Data

Mar. 15, 1974 Japan ..... 49-29023

[52] U.S. Cl. ..... 123/179 G; 123/119 F; 261/39 E; 261/64 R

[51] Int. Cl.[2] F02M 1/10; F02D 11/08; F02M 23/04

[58] Field of Search ..... 123/179 G, 119 F, 179 R; 261/39 B, 39 E, 64 R

[56] References Cited

UNITED STATES PATENTS

| | | | |
|---|---|---|---|
| 3,401,919 | 9/1968 | Seufert et al. | 261/64 R |
| 3,534,720 | 10/1970 | DuBois | 123/119 F |
| 3,818,881 | 6/1974 | Hosho et al. | 123/119 F |

*Primary Examiner*—Wendell E. Burns
*Attorney, Agent, or Firm*—Haseltine, Lake & Waters

[57] ABSTRACT

An automatic choke valve apparatus for an internal combustion engine comprising a choke valve mounted in an intake passage of an internal combustion engine and having an operation shaft connected to a driving shaft of an external pulse motor through an intermediate torsion spring and through circumferentially disposed front and rear pawls such that drive rotation from the motor can be effected only in the regular direction of rotation thereof. A driving pulse circuit is connected to the pulse motor to drive the same between first through fourth sequential operation conditions by respective detecting of the closure of an engine ignition switch, closure of an engine starter switch, beginning of complete firing of the engine, and continuing of the complete firing. The motor is driven in reverse direction of rotation in the first operation condition and in sequential regular direction of rotation in the second to forth operation conditions. In the first operation condition the motor is driven in predetermined high speed reverse direction of rotation, whereas in the second operation condition, it is driven in the regular direction of rotation for a predetermined constant time interval at a speed corresponding to engine temperature, whereas in the third operation condition, it is driven in regular direction of rotation at a predetermined high speed for a constant time interval, while in the fourth operation condition it is driven in the regular direction of rotation at a speed corresponding to engine temperature.

8 Claims, 9 Drawing Figures

AUTOMATIC CHOKE VALVE APPARATUS FOR AN INTERNAL COMBUSTION ENGINE

FIELD OF THE INVENTION

This invention relates to automatic choke valve apparatus in an internal combustion engine for a motorcar or the like.

PRIOR ART

Hitherto, this kind of apparatus is of such a construction that a bimetallic element is provided on one side of a choke valve so that the valve may be operated by thermal expansion and contraction of the bimetallic element. This has the disadvantage, however, that due to the fact that the driving force of the bimetallic element is comparatively weak, it is difficult for the bimetallic element to move the valve smoothly and reliably and thus the control characteristic feature of this apparatus becomes unavoidably inaccurate.

In another known type of apparatus, a vacuum-pressure operated type diaphragm is employed which operates by detecting complete firing of the engine i.e. starting thereof such that, on such complete firing, the choke valve is automatically opened by the diaphragm to a complete firing open-degree position. This construction has the disadvantage that there is caused a stage difference between such an operation and the subsequent valve opening operation by the bimetallic element.

SUMMARY OF THE INVENTION

An object of this invention is to provide apparatus which is free from the disadvantages of the known constructions.

According to the invention, an operation shaft is connected to a choke valve mounted in an intake passage of an internal combustion engine and a driving shaft is connected to a pulse motor external of the engine, the shafts being interconnected through an intermediate torsion spring and being in driving engagement with one another through circumferentially disposed front and rear pawls so that a feed rotation may be effected only in the regular direction of rotation of the driving shaft, a driving pulse circuit being connected to the pulse motor and so constructed that the pulse motor can be changed over between first to fourth operation conditions by respective detecting of the closure of an engine ignition switch, closure of an engine starter switch, beginning of complete firing of the engine and continuing of the complete firing, the arrangement being such that the motor is driven in reverse direction of rotation in the first operation condition and sequentially in regular directions of rotation in the second to the fourth operation conditions.

According to a feature of this invention, in the foregoing arrangement, the motor is given a predetermined high speed reverse direction of rotation in the first operation condition, a predetermined constant time interval regular direction of rotation at a speed corresponding to engine temperature in the second operation condition, a predetermined constant time interval of regular direction of rotation at a predetermined high speed in the third operation condition and a regular direction of rotation at a speed corresponding to engine temperature in the fourth operation condition.

According to a further feature of this invention, the motor is stopped following the foregoing regular direction of rotation in the second operation condition.

The applicant has previously proposed a type of internal combustion engine for a motorcar or the like in which the combustion chamber thereof is composed of a main combustion chamber positioned above a piston and a subsidiary combustion chamber or prechamber, connected to the main combustion chamber through a torch nozzle, and having a spark plug therein, and the arrangement is such that a lean mixture is supplied through a main intake passage to the main combustion chamber and a rich mixture is supplied through a subsidiary intake passage to the subsidiary combustion chamber.

According to a further feature of this invention, chiefly directed to useful application to this type of engine, the foregoing choke valve is used as a main choke valve in a main intake passage connected to the main combustion chamber of the engine, and there is provided on one side thereof a a subsidiary choke valve in a subsidiary intake passage connected to the subsidiary combustion chamber of the engine, the foregoing driving shaft and a shaft of the subsidiary choke valve being interconnected through a link having a lost motion mechanism.

DETAILED DESCRIPTION

Figure 1:
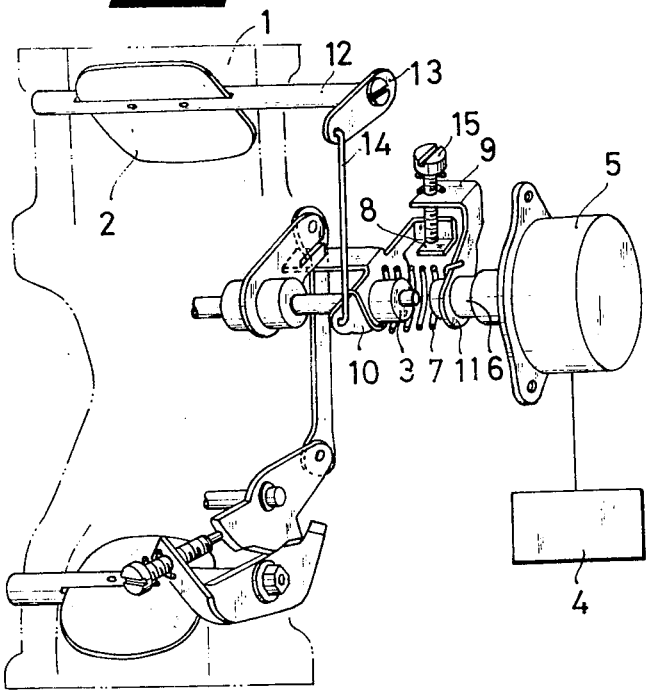
FIG. 1 is a perspective view of one embodiment of apparatus according to this invention.
Figure 2:
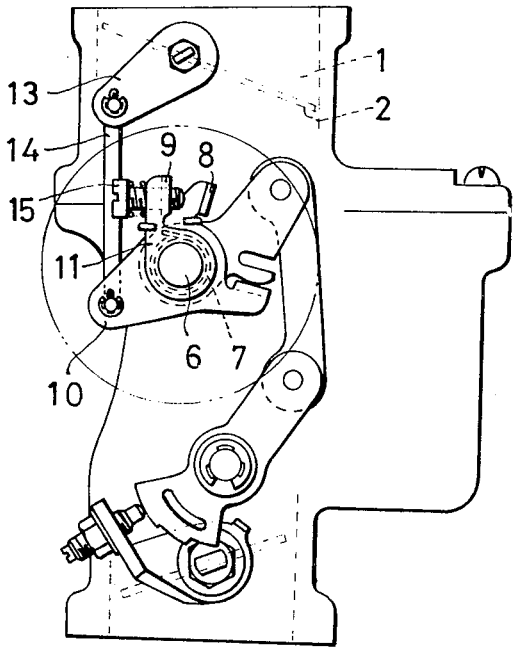
FIG. 2 is a side view thereof.

Referring to the drawings, numeral 1 denotes an intake passage for an internal combustion engine, numeral 2 denotes a choke valve mounted in the passage 1 so as to be movable to open and close the same, and numeral 3 denotes an operation shaft connected to the valve 2. There are provided, on the outside of the operation shaft 3, a pulse motor 5 connected to a driving pulse circuit 4 and a driving shaft 6 connected to the motor 5. The operation shaft 3 and the driving shaft 6 are arranged substantially in alignment with one another, and these are interconnected through an intermediate coilshaped torsion spring 7 and, additionally, they are in engagement with one another through a front pawl 8 projecting from the operation shaft 3 and a rear pawl 9 projecting from the driving shaft 6, these pawls being disposed in front and rear relationship on a circle, so that a feed-driving operation can be obtained only in the regular direction of rotation of the driving shaft 6. Thus, if from the condition in which the two pawls 8, 9 are in contact one with another as shown in FIG. 1, the driving shaft 6 is rotated in its regular direction, that is, in the clockwise direction in the drawing, the operation shaft 3 is also rotated in its regular direction by being feed-driven through the pawl 8, whereas if the driving shaft 6 is rotated in the reverse direction, that is, counterclockwise, the pawl 9 is gradually separated from the pawl 8 so that no feed-driving therethrough is caused and the operation shaft 3 can be driven by the driving shaft 6 only through the torsion spring 7. If, during this operation, the choke valve 2 reaches its fully closed position as shown in FIG. 2, the valve 2 and the operation shaft 3 connected thereto are prevented from being further rotated, so that thereafter rotation of the driving shaft 6 only twists the torsion spring 7 and serves only for increasing its resilient force. In other words, it then operates only for gradually increasing the resilient force of the torsion spring 7 urging the choke valve 2 towards its closing position.

In the illustrated embodiment, the operation shaft 3 and the driving shaft 6 are provided with radial side arms 10, 11 projecting therefrom and the respective tip portions thereof are formed as said pawls 8, 9, the base end portion of the side arm 10 being connected through a rod 14 to a choke lever 13 mounted on the outer end of a shaft 12 of the choke valve 2. For adjusting the contact point between the two pawls 8, 9 forwards and rearwards, one of them, for instance, pawl 9 is provided with an adjustable screw 15 screwed therein.

Figure 3:
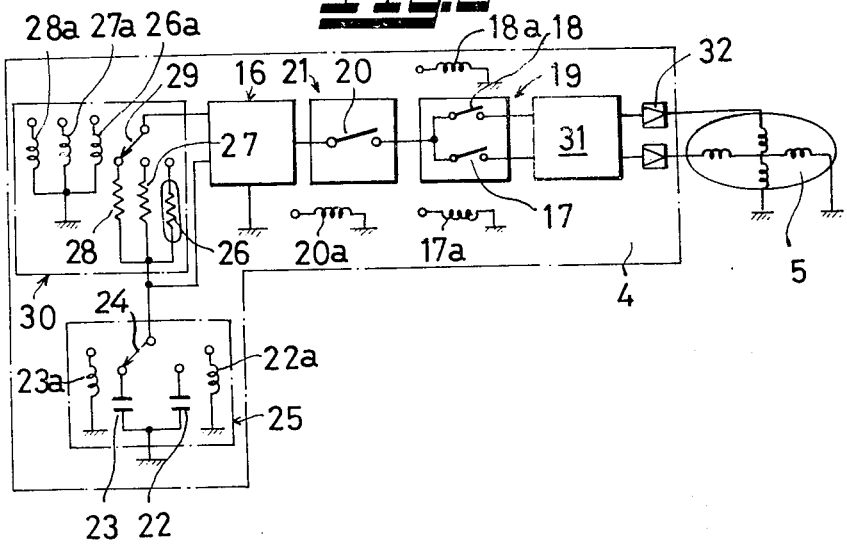
FIG. 3 is a circuit diagram of a driving pulse circuit.

The driving pulse circuit 4 is constructed as shown in FIG. 3 and comprises a pulse generator 16, and a circuit connected between the generator 16 and the pulse motor 5 including a regular and reverse changeover curcuit 19 comprising a regular connection switch 17 and a reverse connection switch 18, and in series therewith, a holding circuit 21 comprising a holding switch 20, which can be opened and closed, so that the motor 5 can be halted thereby. Furthermore, the generator 16 is provided with an oscillation frequency increasing and decreasing circuit 25 comprising two condensers 22, 23 and a switch 24 for selecting either thereof, so that the rotation speed of the motor 5 can be changed-over to either high speed or low speed. Namely, if the condenser 22 is selected, the oscillation frequency is decreased, and the motor 5 is driven in low speed rotation.

The generator 16 is additionally provided with a frequency-changeover circuit 30 comprising a first resistance of variable type 26 which is variable in response to engine temperature, second and third resistances of fixed type 27, 28 which are not responsive to engine temperature and a switch 29 for selecting any of the resistances, so that the rotation speed of the motor 5 can be changed-over between one speed corresponding to engine temperature and two constant speeds not corresponding thereto. Numeral 31 denotes a pulse distributor and numeral 32 a pulse amplifier provided on the input side of the motor 5.

The foregoing regular and reverse changeover circuit 19 is provided with individual operation solenoids 17*a*, 18*a*, corresponding to the respective switches 17, 18, the holding circuit 21 is provided with an operation solenoid 20*a* corresponding to the switch 20, the frequency increasing and decreasing circuit 25 is provided with individual operation solenoids 22*a*, 23*a* corresponding to the respective condensers 22, 23, and the frequency changeover circuit 30 is provided with individual operation solenoids 26*a*, 27*a*, 28*a* corresponding to the first to third resistances 26, 27, 28.

Figure 4:
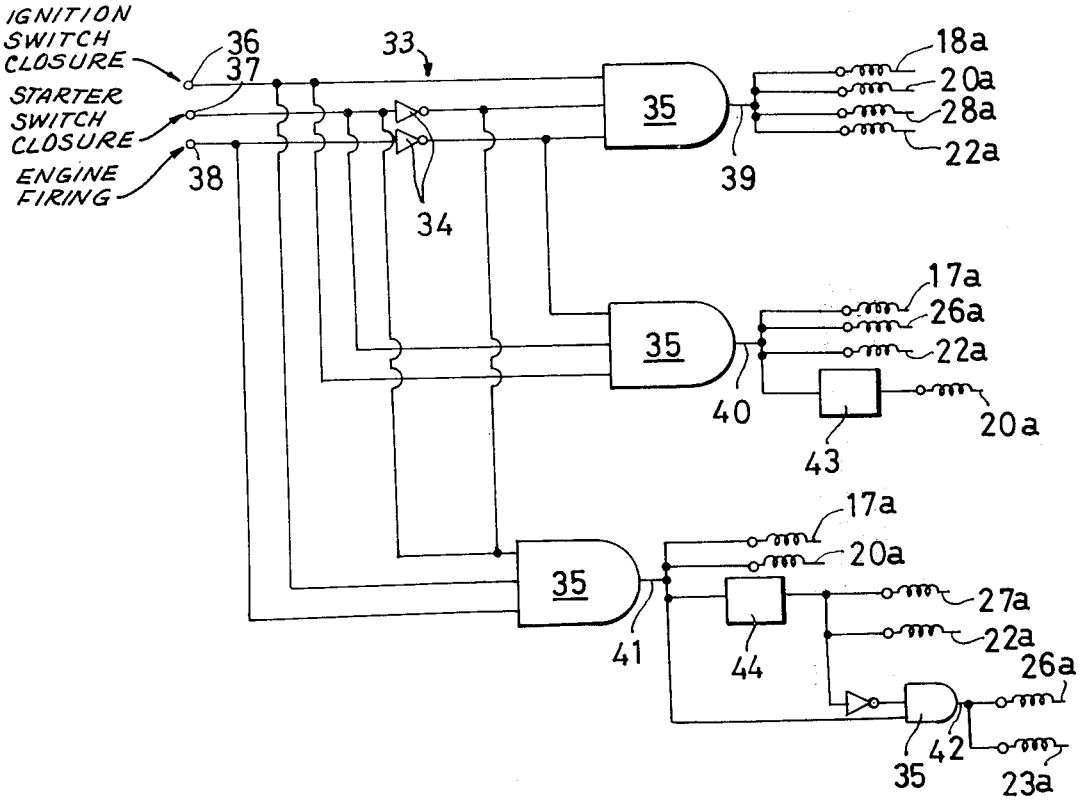
FIG. 4 is a circuit diagram of a selection operation circuit.

These operation solenoids 17*a*, 18*a*, 20*a*, 22*a*, 23*a*, 26*a*, 27*a*, 28*a* are selectively operated by respective detection signals corresponding to closing of an engine ignition switch, closing of an engine starter switch, beginning of a complete firing of the engine and continuance of the complete firing, so that the circuit 4 can be changed over, in sequence between first and fourth operation conditions. For effecting this, a selection operation circuit 33 is constructed, for instance, as shown in FIG. 4. Namely, the circuit 33 is composed of a combination of plural invertors 34 and plural AND circuits 35, and the same is provided on its input side with a first input terminal 36 corresponding to the detection signal of the closing of the ignition switch, a second input terminal 37 corresponding to the detection signal of the closing of the starter switch and a third input terminal 38 corresponding to the detection signal of the complete firing of the engine. Additionally, the circuit 33 is provided on its output side with a first output terminal 39 which provides an output signal when the first input terminal 36 is applied with an input signal by closing the ignition switch, a second output terminal 40 which provides an output signal when both the first and the second input terminals 36, 37 are applied with the respective input signals by subsequently closing the starter switch, a third output terminal 41 which provides an output signal when the first and the third input terminal 36, 38 are applied with the respective input signals when complete firing of the engine is then brought about, and a fourth output terminal 42 which provides an output signal when the first and the third input terminals 36, 38 are continued to be applied with the respective input signals while complete engine firing is continued, and the foregoing respective operation solenoids are selectively connected to the output terminals 39, 40, 41, 42 as follows:

Namely, the operation solenoids 18*a*, 20*a*, 28*a*, 22*a* are connected in parallel with one another to the first output terminal 39, the operation solenoids 17*a*, 26*a*, 22*a*, 20*a* are connected in parallel with one another to the second output terminal 40, the operation solenoid 20*a* being in series with a timer 43 for delaying the beginning of the operation thereof, and the operation solenoids 17*a*, 20*a*, 27*a*, 22*a* are connected in parallel with one another to the third output terminal 41, the operation solenoids 27*a*, 22*a* being in series with a timer 44 so that the operation of each thereof is limited within a predetermined constant time interval. The fourth output terminal 42 is connected through the timer 44 to the third terminal 41 so as to correspond to the foregoing input continuance, and the operation solenoids 26*a*, 23*a* are connected in parallel one with another to the output side of the fourth output terminal 42 so that these solenoids can be changed over in operation from the operation solenoids 27*a*, 22*a*. Thus, by the output operation of the first output terminal 39, the pulse generator 16 oscillates at a comparatively high frequency determined by the third resistance 28 and the condenser 22 and is connected through the holding switch 20 and the reverse connection switch 18 to the motor 5, so that the driving pulse circuit 4 is set into the first operation condition and the motor 5 is driven in reverse direction of rotation at a predetermined high speed. By the subsequent operation of the second output terminal 40, the pulse generator 16 oscillates at a frequency determined by the first resistance 26 and the condenser 22, that is, at a comparatively high frequency corresponding to engine temperature and is connected through the holding switch 20, which closes for a time period determined by the timer 43, and the regular connection switch 17 to the motor 5, so that the circuit 4 is set into the second operation condition and the motor 5 is driven in a regular direction of rotation at a comparatively high speed for a predetermined constant time period corresponding to the engine temperature and is then automatically stopped. By the sequence output operation of the third output terminal 41, the pulse generator 16 oscillates at a comparatively high frequency determined by the second resistance 27 and the condenser 22 and is connected through the holding switch 20 and the regular connection switch 17 to the motor 5, so that the circuit 4 is set into the third operation condition and the motor 5 is driven at predetermined high speed in regular direction of rotation for a predetermined constant time period determined by the timer 44. By the output operation of the fourth output terminal 42 after the lapse of the foregoing constant time interval, the pulse generator 16 oscillates at a comparatively low frequency corresponding to engine temperature, determined by the first resistance 26 and the condenser 23 and is connected to the motor 5 through the holding switch 20 and the regular connection switch 17, so that the circuit 4 is set into the fourth operation condition and the motor 5 in regular direction of rotation at a comparatively low speed corresponding to the engine temperature.

Figure 5:
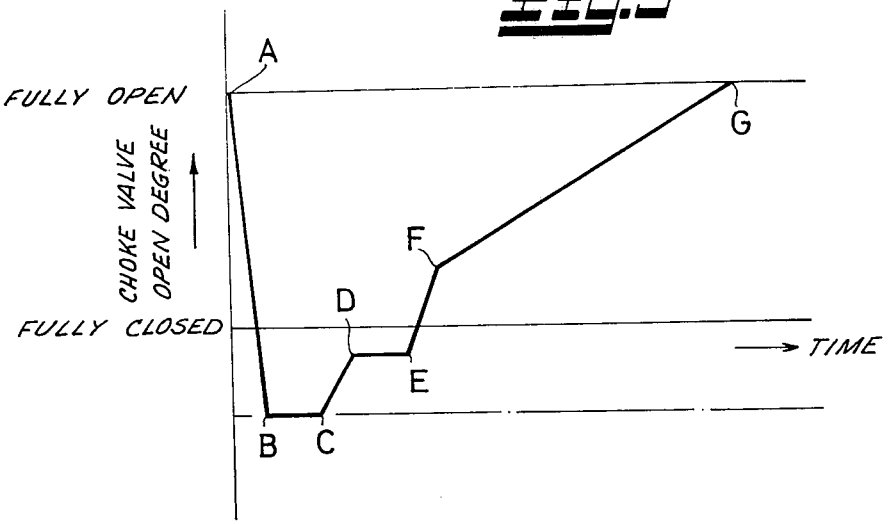
FIGS. 5 and 6 are graphs showing the operation thereof.
Figure 6:
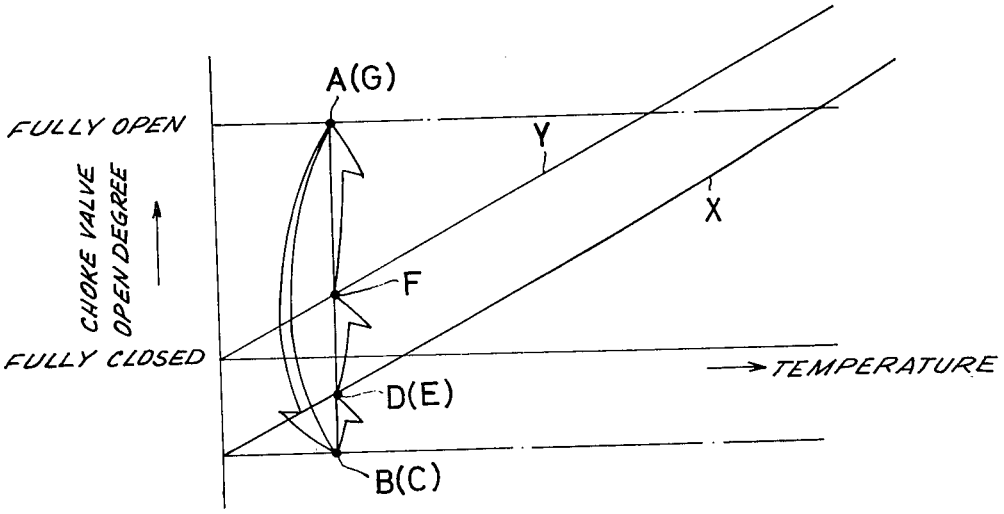

By these sequential reverse direction and regular direction rotations of the motor 5, the choke valve 2 is ordinarily in the fully open position as shown by point A in FIGS. 5 and 6. If, from this condition, the ignition switch is closed for starting the engine, the driving pulse circuit 4 is brought into the first operation condition and the motor 5 is given a predetermined high speed reverse direction of rotation as mentioned above, so that the driving shaft 6 imparts, through the torsion spring 7 to the operation shaft 3, a rotation in counterclockwise direction in FIG. 1. The valve 2 reaches a fully closed position, and the valve 2 and the operation shaft 3 are restrained from being further rotated, continued reverse direction of rotation of the shaft 6 acting only to impart a twist in the same direction to the torsion spring 7. Thus at a prescribed point as shown at point B in FIGS. 5 and 6 the output of the motor 5 and the resilient force of the spring 7 are balanced with one another, whereby the choke valve 2 is stabilized under a large closing resilient force by the spring 7.

If the starter switch is then closed at a time point C as shown in FIG. 5 after the lapse of a proper interval of time, the driving pulse circuit 4 is set into the second operation condition as described above and the motor 5 is given a predetermined constant time of rotation in the regular direction at a comparatively high speed corresponding to engine temperature so that the condition of the valve moves from point C to point D. Namely, by the foregoing regular direction rotation of the motor 5, the torsion spring 7 is rotated at its right end in FIG. 1 in the clockwise direction and thereby the resilient force thereof is decreased by the amount of rotation of the motor 5. In other words, the choke valve 2 is so adjusted that the large closing resilient force of the spring 7 which had been previously applied thereto is decreased according to the engine temperature, and thus the choke valve is ready for an engine starting operation under a resilient force corresponding to the engine temperature. As mentioned above, the driving pulse circuit 4 is stopped in operation at the end of the second operation condition. Namely, the motor 5 is stopped after the foregoing regular direction of rotation thereof, so that the condition of point D moves to a point E, and thus the choke valve 2 is kept stable in the foregoing engine starting condition even if beginning of the complete firing of the engine is delayed due to a starting miss.

If, then, complete firing of the engine begins, the circuit 4 is changed to the third operation condition and the motor 5 is driven in a constant time interval with regular direction of rotation at a comparatively high speed, whereby the choke valve condition moves from point E to a point F. Specifically, by the foregoing regular direction of rotation of the motor 5, the driving shaft 6 first relieves the torsion spring 7 from its stressed condition and then imparts a feed-drive to the operation shaft 3 through the pawls 9, 8, whereby the choke valve 2 is set into a complete firing open-degree position which is slightly opened from the fully closed position. As mentioned before, the movement from the point C to the point D is carried out over a constant time interval at a speed corresponding to the engine temperature, and the movement from the point E to the point F is carried out at the predetermined high speed over constant time interval, so that it will be easily understood that the distance between the point E, F, is always constant as shown in FIG. 6, and if the engine temperature is changed the points E, F only move along parallel lines X, Y.

By continuance of the complete firing of the engine, the circuit 4 is changed over into the fourth operation condition and the motor 5 is driven in the regular direction of rotation at a comparatively low speed corresponding to engine temperature, and thus the point F is gradually moved towards a point G along a comparatively gentle gradient. More specifically, the motor 5, and accordingly, the driving shaft 6 rotate in the regular direction at a comparatively low speed corresponding to the engine temperature, so that the operation shaft 3 is driven through the pawls 9, 8 and the choke valve 2 is gradually opened in accordance therewith. Thus, the choke valve 2 is gradually opened at a speed corresponding to the increase of engine temperature and advantageously follows the engine operation.

Figure 7:
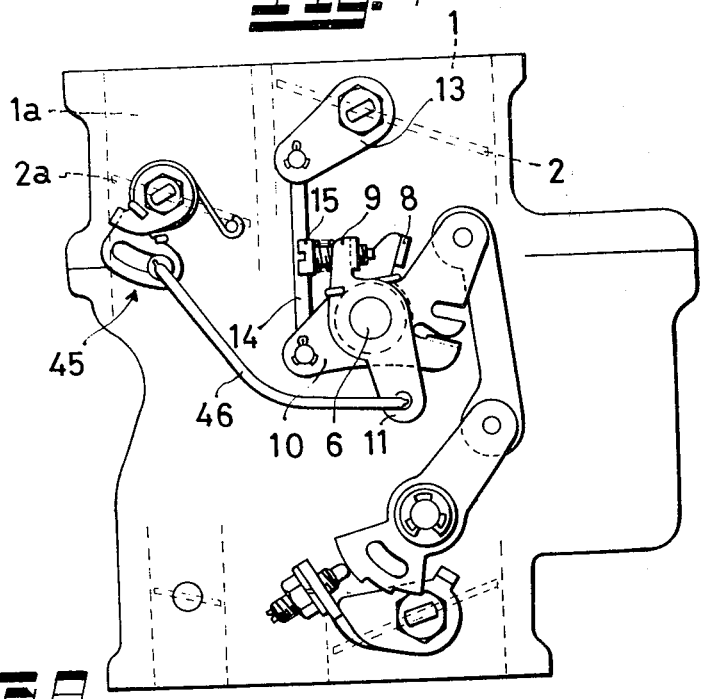
FIG. 7 is a side view of a modified embodiment of apparatus according to this invention.
Figure 8:
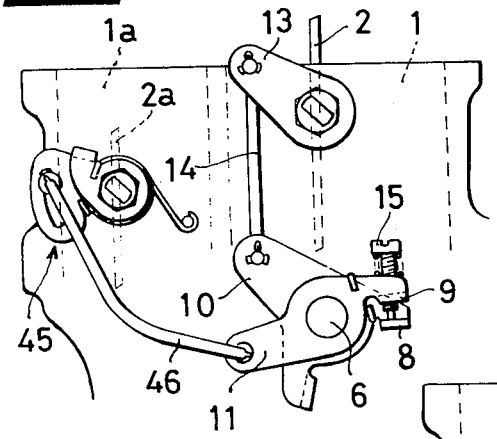
FIGS. 8 and 9 are side views thereof in different respective operation conditions.
Figure 9:
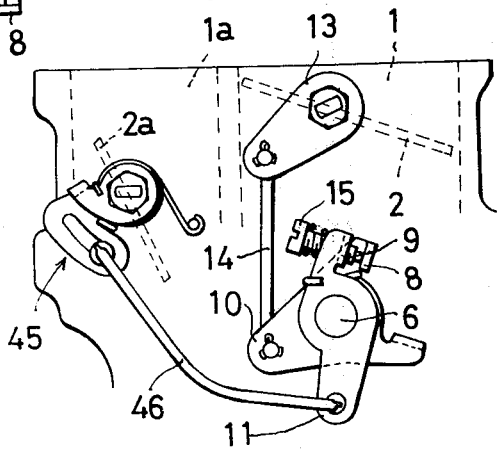

FIGS. 7 to 9 show the case where the apparatus of the invention is applied to an internal combustion engine of main and subsidiary combustion chamber type. In this case, the intake passage 1 in the foregoing embodiment is used as a main intake passage connected to the main combustion chamber and the choke valve 2 in the above embodiment is interposed therein as a main choke valve, and there is provided on one side thereof a subsidiary intake passage **1*a* connected to the subsidiary combustion chamber and a subsidiary choke valve 2*a* interposed therein. This subsidiary choke valve 2*a* is connected to the base end portion of the side arm 11 on the driving shaft 6 through a link 46 having at one end portion a lost motion mechanism 45. Thus, when the driving shaft 6 is largely rotated in the reverse direction, from the condition as shown in FIG. 8, under the first operation condition of the driving pulse circuit 4, the main choke valve 2 is brought into its fully closed position as shown in FIG. 9 and is restrained in that position so as not to be further rotated, and the subsidiary choke valve 2*a* is partly closed as also shown in FIG. 9. By further rotation of the driving shaft 6 in the same direction, the subsidiary choke valve 2*a* is then brought into its fully closed position as shown in FIG. 7. When the main choke valve 2 is thereafter fully opened as shown in FIG. 8, the subsidiary choke valve 2*a* is also brought into its fully open position, and during this operation the motion is absorbed by the lost motion mechanism 45, so that the subsidiary choke valve 2*a*** can be prevented from being given any immoderate rotation.

Thus, according to this invention, the pulse motor is used instead of a conventional bimetallic element, so that the disadvantages such as unstable operation caused by insufficient driving force by the bimetallic element can be eliminated. Additionally, the motor is changed over in sequence from the first to the fourth operation conditions so as to move therewith the choke valve through the torsion spring and the feeddriving mechanism comprising the front and rear pawls, so that the valve can smoothly and accurately reach the standard positions, i.e. the engine starting ready position, the open degree position at complete firing of the engine and the subsequent increase of open degree in compliance with the engine requirements.

According to a feature of this invention, the motor is stopped at the end of the second operation condition, so that there is not caused any inconvenience even by a starting miss at this stage. According to a further feature of this invention, the apparatus is advantageously applicable to an engine of main and subsidiary combustion chamber type.

What is claimed is:

1. An automatic choke valve apparatus for an internal combustion engine comprising a choke valve mounted in an intake passage of an internal combustion engine, an operation shaft connected to said choke valve, an external pulse motor including a drive shaft, an intermediate torsion spring connecting said operation shaft and said drive shaft, coupling means between said shafts for imparting drive from said drive shaft to said operation shaft only in regular direction of rotation of the drive shaft, and a driving pulse circuit means connected to said pulse motor for driving the same between first through fourth operation conditions by respective detecting of closure of an engine ignition switch, closure of an engine starter switch, beginning of complete firing of the engine and continuing of the complete firing, said motor being driven in reverse direction of rotation in the first operation condition and in sequential regular directions of rotation in the second to fourth operation conditions.

2. An automatic choke valve apparatus as claimed in claim 1, wherein said motor is driven in predetermined high speed reverse direction of rotation in the first operation condition, a predetermined constant time interval in regular direction of rotation at a speed corresponding to engine temperature in the second operation condition, a predetermined constant time interval at regular direction of rotation at a predetermined high speed in the third operation condition and regular rotation at a speed corresponding to engine temperature in the fourth operation condition.

3. An apparatus as claimed in claim 2, wherein said pulse circuit means stops said motor following the regular direction of rotation in the second operation condition.

4. An apparatus as claimed in claim 1, wherein said choke valve is mounted in a main intake passage connected to a main combustion chamber of the engine, and further comprising a subsidiary choke valve mounted in a subsidiary intake passage connected to a subsidiary combustion chamber of the engine, and means connecting said driving shaft with the subsidiary choke valve including a lost motion mechanism.

5. An apparatus as claimed in claim 1 wherein said coupling means comprises respective pawls on said shafts in engagement with one another.

6. An apparatus as claimed in claim 5 comprising adjustment means between said pawls for adjusting the relative angular positions of said shafts.

7. An apparatus as claimed in claim 1 wherein said driving pulse circuit means comprises a pulse generator coupled to said motor and means connected to the pulse generator for varying oscillation frequency thereof.

8. An apparatus as claimed in claim 7 wherein said means for varying the oscillation frequency of the pulse generator comprises a plural stage circuit for different oscillation frequencies, and a changeover circuit connected to said plural stage circuit and to said pulse generator, said changeover circuit including stages which are both fixed and responsive to engine temperature.

* * * * *